United States Patent [19]

Warnock, Sr.

[11] 4,393,928

[45] Jul. 19, 1983

[54] APPARATUS FOR USE IN REJUVENATING OIL WELLS

[76] Inventor: Charles E. Warnock, Sr., P.O. Box 509, Ventura, Calif. 93002

[21] Appl. No.: 296,640

[22] Filed: Aug. 27, 1981

[51] Int. Cl.[3] ..... E21B 43/00

[52] U.S. Cl. ..... 166/105; 166/303; 166/327; 137/329.03; 417/260

[58] Field of Search ..... 166/105, 325, 327, 302, 166/303; 137/522, 523, 539, 329.03; 251/82, 83; 417/260

[56] References Cited

U.S. PATENT DOCUMENTS

| | | | |
|---|---|---|---|
| 1,736,486 | 11/1929 | Carnahan | 137/329.03 |
| 1,804,247 | 5/1931 | Conner | 166/148 |
| 2,639,674 | 5/1953 | Reese | 166/105 |
| 2,796,133 | 6/1957 | Dean | 166/332 X |
| 3,662,950 | 5/1972 | McIntosh et al. | 137/522 X |
| 3,814,121 | 6/1974 | Lawson | 137/329.03 |

FOREIGN PATENT DOCUMENTS

| | | | |
|---|---|---|---|
| 712488 | 1/1980 | U.S.S.R. | 175/318 |

*Primary Examiner*—Ernest R. Purser
*Assistant Examiner*—Thuy M. Bui
*Attorney, Agent, or Firm*—Ralph B. Pastoriza

[57] ABSTRACT

A sub incorporating a check valve is connected into the lower end of a well pipestring. This valve will pass hot steam injected down the pipestring to the formations to loosen up the thick crude oil. The check valve prevents back flow and thus will hold the high pressure steam. To resume production, the production pump can then be lowered through the pipestring. The pump itself is provided with an extended probe member which will unseat the check valve when the pump is in proper position so that production pumping can resume.

2 Claims, 2 Drawing Figures

APPARATUS FOR USE IN REJUVENATING OIL WELLS

FIELD OF THE INVENTION

This invention relates generally to oil well operations and more particularly to an apparatus for use in rejuvenating oil wells.

BACKGROUND OF THE INVENTION

After prolonged production pumping of oil wells, the crude oil sometimes becomes so thick and cumbersome that it is not possible to produce any further oil from the well. Under these conditions, it is common practice to "rejuvenate" the well by pumping hot steam under high pressure down the well pipestring and out into the formations. This hot steam will loosen up the thick crude oil and thin the oil out sufficiently that production pumping can be resumed.

In the actual rejuvenation process, the well pipestring is provided with a packing close to its lower end to confine the hot steam pumped down the pipestring to the lower annulus of the well so that the steam is forced out into the formations through the well casing perforations. Steam pressure is maintained for a considerable length of time in order that proper rejuvenation can take place. For example, once the steam has been forced down, it is necessary to maintain the pressure for anywhere from 3–5 days or wait a sufficient length of time for the steam to cool and the pressure to gradually diminish before a production pump can be lowered to resume pumping operations.

In an effort to avoid such delays, it has been proposed to keep the production pump in place in the pipestring and inject the steam down through the pump into the formations. However, this has proved to be unsuccessful because of gutting and damage to the pump itself by the hot steam.

As a consequence, in remedial well operations, it is still normally necessary to delay for a considerable length of time for the steam to cool and the pressure to drop before the production pump can be lowered into the well to resume operations.

BRIEF DESCRIPTION OF THE PRESENT INVENTION

With the foregoing considerations in mind, the present invention contemplates an improved apparatus for use in rejuvenating a well wherein the delay period after the steam has been injected into the well until production pumping can be resumed can be shortened substantially, all to the end that the well can be brought back into production far more quickly than has been possible heretofore.

More particularly, in accord with the present invention, the apparatus includes the provision of a check valve means in the lower portion of the pipestring for passing steam into the formations from the pipestring and blocking back flow. This check valve will thus maintain the pressure and heated steam in the formations and will permit a production pump to be immediately lowered to the pipestring since the steam pressure need not be maintained from above. When the production pump reaches its operating level, an appropriate means on the lower end of the pump serves to open the check valve so that production pumping can then be resumed.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
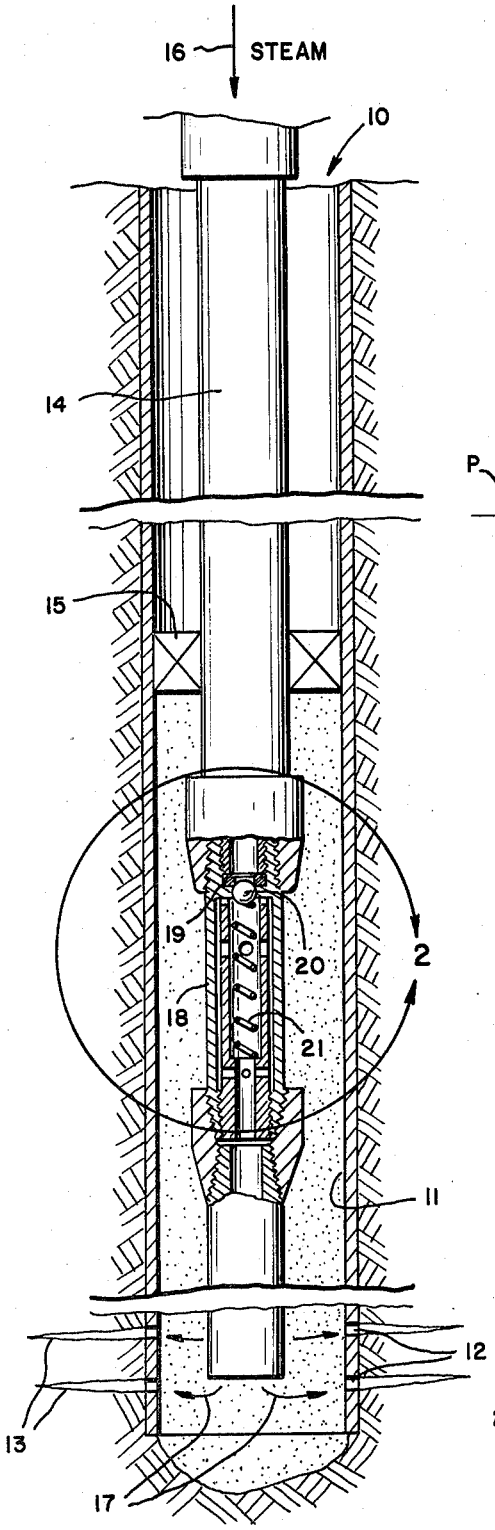
FIG. 1 is a side elevational view, partly in cross section of an oil well incorporating a pipestring wherein the apparatus of the present invention is used in a rejuvenation process.

Referring first to FIG. 1, there is schematically shown an oil well 10 provided with casing 11 through which perforations 12 shown at the lower portion of the well have been made for oil production. Normally, the oil is pumped from the various formation strata indicated at 13 in FIG. 1 into the lower well annulus and up through an appropriate pipestring 14 to the surface. In this respect, there is incorporated in the lower portion of the pipestring a production pump.

In many situations, after prolonged pumping, the crude oil is difficult to extract, primarily because it has thickened in the formations. Rather than simply close down the well, it has been found that the same oftentimes can be rejuvenated by loosening up the thick crude in the formations so that the oil can again be pumped.

One means for rejuvenating the well is to remove the production pump from the pipestring, provide a packing such as indicated at 15 which in many instances may already be present to close off the lower annulus of the well, and then introduce hot steam under high pressure into the top of the pipestring as indicated by the arrow 16. This hot steam will pass down through the pipestring into the annulus below the packing 15 as indicated by the arrows 17 and out into the formations.

The high pressure on the steam may approach 800 lbs. per square inch and is maintained throughout the entire pipestring from the surface to hold the steam pressure in the formations.

After the steam has been introduced, it is necessary to maintain the pressure as the steam gradually cools, resulting in a gradual loss of pressure. This process may take from three to five days and during this time, the well cannot be pumped.

In accord with the present invention, as illustrated in FIG. 1, the foregoing delay can be substantially reduced by introducing a check valve in the lower portion of the pipestring. In this respect, and as shown in FIG. 1, there is provided a sub 18 incorporating the check valve which in turn comprises a seat 19, ball 20 and spring 21 normally urging the ball 20 against the seat 19. The valve operates to permit steam introduced into the top of the pipe string to pass downwardly through the pipestring into the formations. However, this valve will block any reverse flow of steam so that the valve will hold pressure of the steam so that it is no longer necessary to maintain the pressure throughout the length of the pipestring.

As a consequence of utilizing a check valve as described above, the production pump can be lowered down the pipestring immediately after the injection of steam has been completed. The pump itself incorporates means on its end constituting part of the apparatus of this invention for unseating the check valve when the pump is a proper position to start production pumping so that the check valve is automatically opened and normal pumping can resume.

Figure 2:
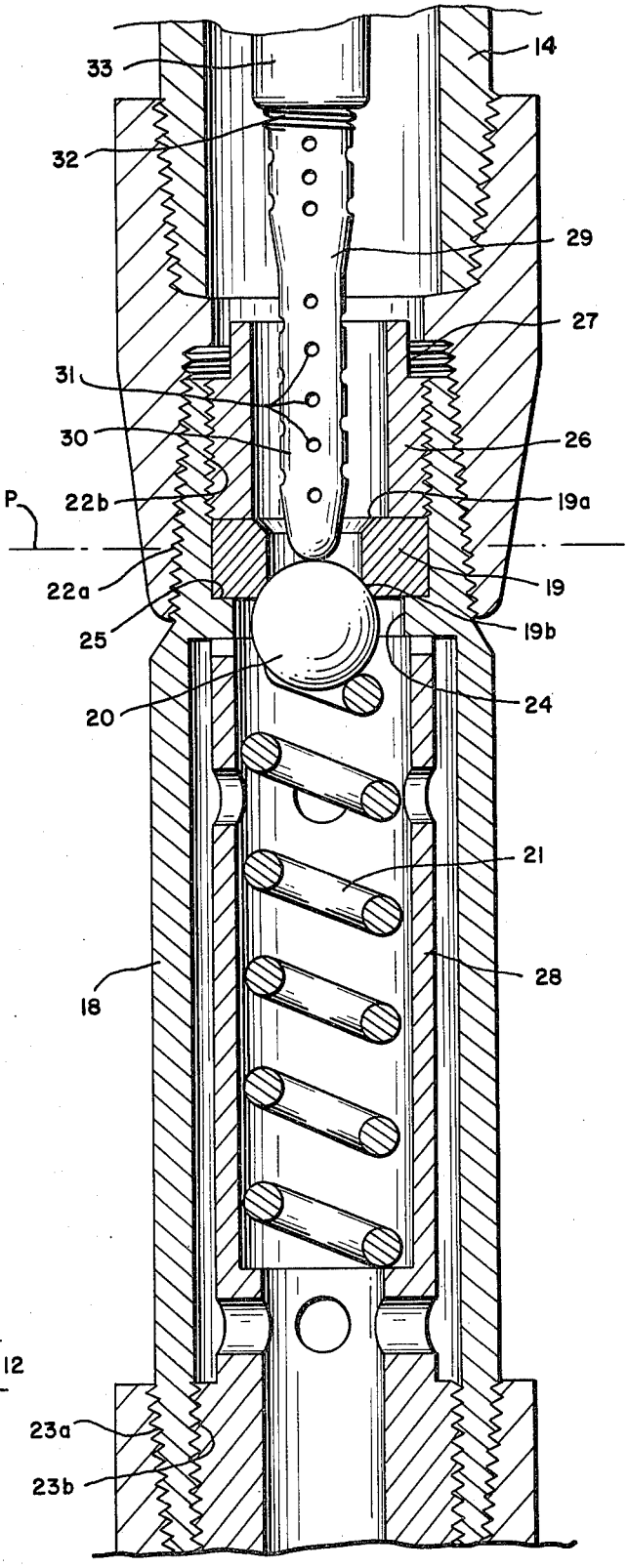
FIG. 2 is a greatly enlarged cross section of that portion of the structure enclosed within the circular arrow 2 of FIG. 1.

All of the foregoing will be better understood by now referring to the detailed view of FIG. 2. As shown, the sub 18 includes upper and lower external and internal threads indicated respectively at 22*a*, 22*b*, and 23*a*, 23*b*. The external threads 22*a* and 23*a* permit substitution of the sub 18 into a conventional pipestring as illustrated in FIG. 1.

Sub 18 further includes a reduced diameter central opening 24 defining an annular shoulder 25 facing towards the upper end of the sub. The valve seat 19 described in FIG. 1 is receivable through the upper end of the sub past the internal threads 22*b* to seat on the annular shoulder 25. A threaded collar 26 is threaded onto the internal threads 22*b* of the upper end of the sub to hold the valve seat 19 against the annular shoulder as shown. Appropriate flats such as indicated at 27 may be provided on the collar 26 to facilitate threading down onto the seat 19 and removal of the collar when it is desired to maintain the parts.

The spring 21 described in FIG. 1 is supported in an appropriate spring cage indicated at 28. Spring cage 28 is threadedly received in the lower internal threads 23*b* of the sub as illustrated. Appropriate openings are provided in the cage so that fluid passing through the check valve can continue on down through the sub. It will be noted that the cage is appropriately positioned so that the spring 21 will exert a biasing force on the ball 20 in a manner to urge the ball upwardly through the reduced diameter central opening 24 against the valve seat.

With the foregoing construction, it will be appreciated that the check valve can be readily disassembled by simply unthreading the collar 26 and the spring cage member 28 so that the parts can be easily replaced or cleaned as required.

A feature of the present check valve is the fact that the valve seat 19 has symmetrical opening peripheries on either side of a mid-plane passing normal to the axis of the seat openings. Thus, the two opening peripheries are indicated at 19*a* and 19*b*, these peripheries being symmetrical as stated to the central plane P. As a result of this construction, the valve seat can be removed and turned upside-down so that its opposite opening periphery can be used to seat the ball 20. Thus, should the seat periphery 19*b* shown in FIG. 2 become pitted or unusable after prolonged use, the valve seat 19 itself can be removed and turned over to present the seat 19*a* for use with the ball 20.

The parts of the check valve itself such as the valve seat and ball are made of hardened heat resistant carbon steel. Similarly, the spring 21 is made of appropriate material to resist heat and still function properly.

Referring to the upper portion of FIG. 2, there is shown at 29 a hollow probe member having a lower narrow nose portion 30 with a plurality of openings 31 in its lateral wall. The diameter of the nose portion 30 is less than the diameter of the valve seat 19 so that the probe can pass through the seat and engage the ball 20 to unseat the same.

The upper end of the probe member 29 is provided with threads 32 for threaded engagement with the lower end of the production pump illustrated at 33. Normally, there would be provided a pump screen threaded to this lower end of the pump. The probe member 29 is designed with the threads 32 to serve as a substitute for the pump screen and provide the further function of unseating the ball 20 for the check valve when the pump 33 itself is in proper position to resume production pumping.

It will now be clear that after steam has been injected into the well, the check valve will hold the pressure and block back flow so that the production pump can immediately be lowered while the well is cooling and the pressure is dropping. Probe member 29 will serve to enter the valve seat and unseat the check valve ball to thereby open the check valve and permit normal production pumping of the well to resume.

The present invention, accordingly, has provided a very useful apparatus for use in rejuvenating oil wells wherein time delays involved between the time that steam has been injected and the time to resume production pumping is greatly reduced.

I claim:

1. An apparatus for use in rejuvenating oil wells wherein such rejuvenation involves injecting steam through a pipestring and holding the steam under pressure in the well for a period of time before a production pump is lowered into the pipestring to resume production pumping operations, including, in combination:

(a) a sub incorporating a check valve comprising a valve seat, ball and spring biasing the ball against the seat, said sub having exterior upper and lower threads for insertion into the pipestring so that steam can pass down through the pipestring and through the check valve to the surrounding formations, the check valve blocking back flow of steam into the pipestring, said sub having internal threads at its upper and lower ends, and a reduced diameter central opening defining an annular shoulder facing said upper end, said seat being receivable in said upper end for seating on said annular shoulder; a threaded collar received in said upper internal threads to hold said seat against said annular shoulder; and a spring cage threadedly received in said lower internal threads of said sub for holding said spring for said check valve in a manner to urge said ball upwardly through the reduced diameter central opening against said valve seat, whereby said check valve can be easily disassembled for maintenance purposes; and (b) a hollow probe member having a lower narrow nose portion with a plurality of openings in its lateral wall, the diameter of said nose portion being less than the diameter of the seat for said check valve, the upper end of said probe member having threads for threaded engagement with the lower end of said production pump such that the probe member can be substituted for the normal pump screen threadedly held therein, whereby after steam has been injected into the well, the check valve will hold the pressure and block back flow so that said production pump can immediately be lowered while said well is cooling and the pressure is dropping, said probe member serving to enter said valve seat and unseat said ball to thereby open said check valve and permit production pumping of the well to resume.

2. An apparatus according to claim 1, in which said valve seat and ball are made of hardened, heat-resistant carbon steel, said seat having symmetrical opening peripheries on either side of a mid-plane passing normal to the axis of the seat openings so that the seat can be turned over and its opposite opening periphery used to seat said ball.

* * * * *